US005772312A

United States Patent [19]

Pihl-Niederman et al.

[11] Patent Number: 5,772,312

[45] Date of Patent: Jun. 30, 1998

[54] LIGHTED HOLIDAY ORNAMENT

[76] Inventors: Susan M. Pihl-Niederman, 405 Brockton La. North; Hollyanne M. Pihl, 430 Brockton La. North; Sharon P. Frederickson, 845 Brockton La. North, all of Plymouth, Minn. 55447

[21] Appl. No.: 739,637

[22] Filed: Oct. 30, 1996

[51] Int. Cl.[6] ..... F21V 21/00

[52] U.S. Cl. ..... 362/249; 362/238; 362/240; 362/252; 362/806

[58] Field of Search ..... 362/238, 239, 362/240, 234, 249, 250, 252, 806, 363

[56] References Cited

U.S. PATENT DOCUMENTS

| | | | |
|---|---|---|---|
| 960,466 | 6/1910 | Weissmann . | |
| 1,636,141 | 7/1927 | Mammen . | |
| 1,832,576 | 11/1931 | Palmer . | |
| 2,248,883 | 7/1941 | Lehigh . | |
| 2,474,356 | 6/1949 | Harris . | |
| 3,500,036 | 3/1970 | Szentveri . | |
| 3,692,993 | 9/1972 | Robinson . | |
| 3,731,081 | 5/1973 | Yellin | 161/12 X |
| 4,774,646 | 9/1988 | L'Heureux | 362/249 |
| 4,995,181 | 2/1991 | Wolf | 40/152.2 |
| 5,031,083 | 7/1991 | Claesson | 362/249 |
| 5,067,061 | 11/1991 | Prickett | 362/145 |
| 5,161,882 | 11/1992 | Garrett | 362/249 |
| 5,404,279 | 4/1995 | Wood | 362/145 |
| 5,410,459 | 4/1995 | Yang | 362/249 |
| 5,416,678 | 5/1995 | Schabowski | 362/249 |
| 5,442,531 | 8/1995 | Lee | 362/249 |
| 5,645,343 | 7/1997 | Rinehimer | 362/252 |

*Primary Examiner*—Stephen F. Husar
*Attorney, Agent, or Firm*—Merchant, Gould, Smith, Edell, Welter & Schmidt, P.A.

[57] ABSTRACT

A lighted ornament includes a hollow shell which houses a portion of a string of lights which exit at opposing ends through one or two cord apertures in the shell. The light bulbs housed within the hollow shell extend through light bulb apertures in the hollow shell, or alternatively, translucent members are secured to the hollow shell to communicate light from the light bulbs and thereby illuminate the ornament. The lighted ornament creates a stunning lighted ball or other shaped ornaments such as a candycane, reindeer, Christmas tree etc. The lighted ornaments are ideally suited for indoor or outdoor use and may be used year after year.

18 Claims, 3 Drawing Sheets

LIGHTED HOLIDAY ORNAMENT

FIELD OF THE INVENTION

The present invention relates to an illuminated ornament suitable for hanging from trees, buildings and other structures.

BACKGROUND OF THE INVENTION

Ornaments have long been used to recognize holidays such as Christmas and Halloween. The ornaments are typically hung indoors or outdoors, e.g., from trees, buildings, store front signs, and other structures which may be adapted to hang bulbs or other festive ornamentation from. Generally, there has been the use of both bulbs and strings of lights. Often times, the strings of lights might be secured to the exterior of a cutout shape, to form an image of characters such as Santa Claus, a reindeer, snowmen, etc. Patents covering such holiday products include U.S. Pat. Nos. 5,442,231, 5,416,678, 5,404,279, 5,161,882, 4,995,181, 4,774,646 and 3,731,081.

It is traditional to decorate trees, both indoor and outdoor trees, with strings of lights as well as different types of ornaments. Such decorations result in beautiful lighted trees with ornaments hanging therefrom. Traditionally, ornaments have been used less frequently on outdoor trees and structures, however, since the ornaments are often difficult to see at night unless there is another source of light.

Thus, a substantial need has existed for a manner of illuminating ornaments so that they may be seen without a separate source of light. Moreover, there is also a need for a manner of illuminating ornaments in an inexpensive yet aesthetically pleasing manner.

SUMMARY OF THE INVENTION

The present invention relates to a unique ornament which employs common strings of lights as well as providing the ability to offer many shapes and sizes. In particular, the present invention provides a hollow shell which houses a portion of a string of lights with opposing ends of the string of lights extending out of the shell through one or more cord apertures, such that the light bulbs housed within the shell illuminate the ornament. The light bulbs may be secured to the shell through light bulb apertures in an exterior surface of the shell such that the light bulbs themselves extend out of the shell. In the alternative, translucent members may be secured to the exterior surface of the shell to permit light generated by the light bulbs housed within the shell to be communicated out of the shell. The shell of any given ornament may utilize a portion or the entire string of lights.

Preferably, the present invention envisions utilizing snap fit shells which contain a portion of a string of lights, such that numerous bulbs may be used in conjunction with one string of lights to provide a magnificent looking string of ornaments which employ unique shapes, colors and lights.

DETAILED DESCRIPTION OF THE PREFERRED EMBODIMENTS

Broadly, the present invention is directed to an ornament which employs a hollow shell to house a plurality of light bulbs from a string of lights for illuminating the ornament. In one embodiment, the hollow shell has openings or apertures wherein light bulbs from a string of lights can protrude therethrough. In another embodiment, translucent members on the shell communicate light generated by the light bulbs. The light bulbs preferably used in preferred embodiments of the invention are bulbs which are commonly available on strings of Christmas or holiday lights. Typically, these strings of lights come in packages wherein there might be 50, 100, 200 or more bulbs per string. The string of lights are often connected in series, such that hundreds and hundreds of bulbs may be strung together to decorate a tree or other article.

Figure 1:
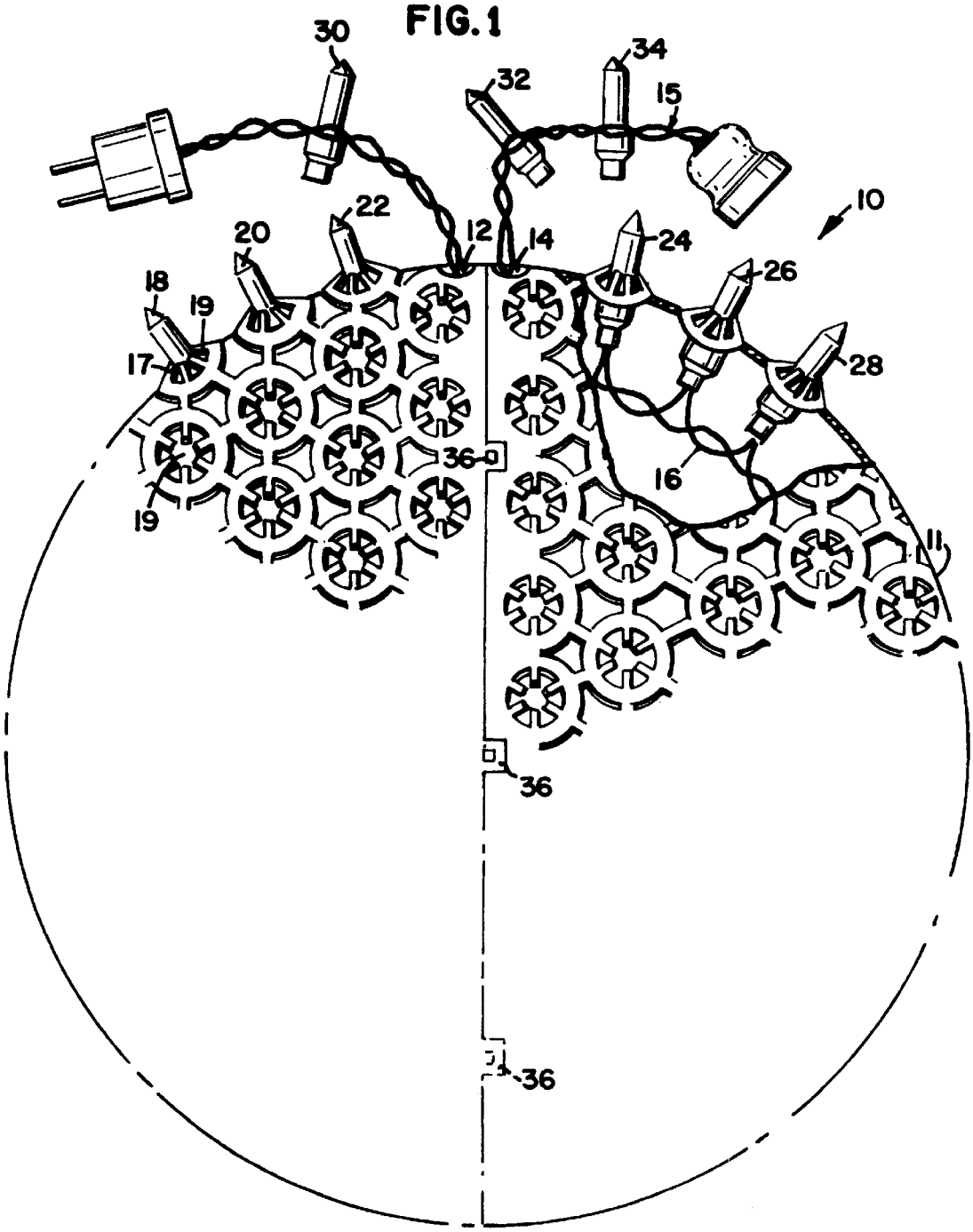
FIG. 1 is a schematic breakaway of one preferred ornament consistent with the invention, with only a portion of the light bulb apertures shown.

As is shown in FIG. 1, one preferred spherical ornament 10 consistent with the invention includes a hollow shell 11 that is typically made of some type of plastic material which may be injection molded or stamped. Typically, a pair of shell halves are injection molded with a living hinge (remaining plastic strip from the fabrication process connecting the two halves together) securing the two halves together. In the alternative, other mechanical hinge arrangements may be used, or no hinge may be used at all, so long as access to the interior area of the shell is permitted. Additionally, the plastic material may be in festive colors such as red and green for Christmas or orange and black for Halloween. Also, the plastic shell may be decorated with some nonplastic material on the exterior such as garland, sparkles, or sequins. The shell is not limited to plastic material, but may be any material which could comprise a shell wherein lights may be located both inside and protruding through the shell. Other examples of materials include wood, rubber or a resin impregnated fiber.

Ornament 10 has preferably two cord apertures 12, 14, wherein a string of lights 15 may enter the hollow ornament at one end through a cord entrance aperture shown as 12 and then exit at another, opposing end through a cord exit aperture 14 such that a portion of the string of lights is housed within the shell of the ornament. In the alternative, only one cord aperture common to both opposing ends of the string of lights may be used.

As shown in FIG. 1, ornament 10 houses light bulbs 18, 20, 22, 24, 26 and 28 of string of lights 15. Lights 30, 32 and 34 are illustrative of how an embodiment is envisioned wherein only a portion of the string of lights is housed in shell 11.

In this embodiment, the light bulbs housed within the shell preferably extend through light bulb apertures 19. Pluralities of small flexible plastic fins, designated as 17, are preferably used to secure light bulbs to the shell when the light bulbs are pushed through apertures 19, as fins 17 restrict removal of the light bulbs from the light bulb apertures. Other manners of retaining the light bulbs in the shell may include rubber gaskets, clips, or any other mechanisms which would allow the light bulbs to be secured on the exterior surface of the shell.

Light bulb apertures 19 may be disposed over a portion of the exterior surface of shell 11, or more preferably, may substantially cover the entire surface of the shell. In this latter instance, a three-dimensional shell may be used that is illuminated from all sides.

Figure 2:
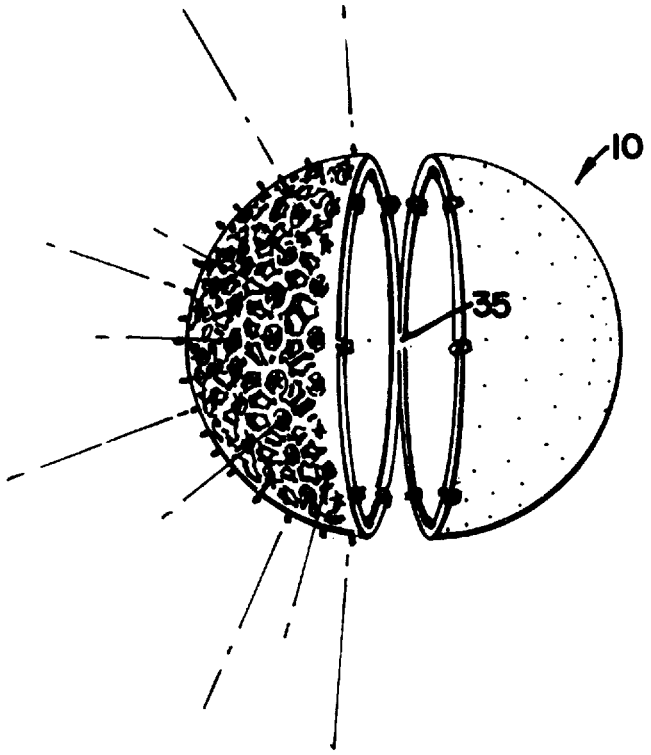
FIG. 2 is a schematic view of the ornament of FIG. 1 in a partially open arrangement.
Figure 3:
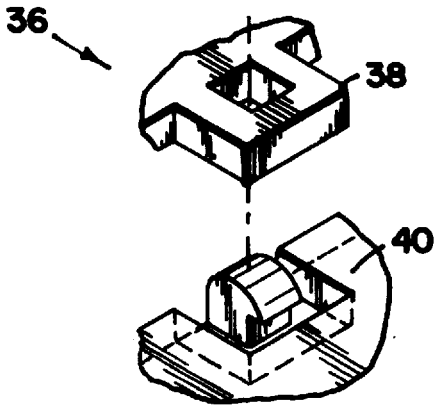
FIG. 3 is a perspective view of one of the clasps on the ornament of FIG. 1.

The shell is preferably formed from a pair of shell halves that may be opened and closed along a hinge 35 (shown in FIG. 2). Shell 11 also has hook and lock clasps 36 including cooperative female members 38 and male members 40 which are best shown in FIG. 3.

Ornament 10 is generally employed using the following steps. A string of lights, having from about 20 or more lights are strung together or comprise one or more strings of lights. What first must be determined is how many ornaments are desired to be hung on the tree. The ornaments may have light capacities varying from very few in number with the possibility of even one light per bulb to a large number even exceeding 100 or more light bulbs in a very large ornament. Typically, an ornament may have a capacity of 30 light bulbs. The ornament 10 is opened like opening a clam, and a portion of the string of lights which is to be housed within the shell and used to light the ornament is positioned adjacent the opened ornament. Thereafter, a light bulb is pushed through each light bulb aperture 19 such as shown in FIG. 1 with light bulbs 18, 20, 22, 24, 26 and 28. This can be done for each light bulb aperture of the ornament, or may be done for just some of the apertures possibly even create a pattern of lights in each ornament. The portion of the string of lights that will be housed within the shell exits the shell at opposing ends through cord entrance and exit apertures 12, 14. Thereafter, another ornament may be employed on the same string, being spaced apart as the user desires, e.g., with a space of 10 inches or more between ornaments.

A particularly appealing feature of the present invention is the continuity created between the ornaments, with a strand of lights connecting each lighted ornament.

The present invention can easily be stored year after year and does not need to be taken apart. After the holiday or special event season is over, the lights may be removed from the tree, but there is no need to take the lights out of the ornaments. Thus, from year to year, the string of lights with the ornaments may be strung on the tree or structure, with the only need to open the ornaments occurring when a light bulb is burned out and needs to be replaced.

The replacement of a light bulb is a simple operation and merely requires that the ornament be opened, the burned out light bulb be pulled through the light bulb aperture, the light bulb replaced, and the fresh light bulb pushed back into the light bulb aperture.

The ornament 10 preferably should have some type of hanging hook or other mechanism to hang the ornament. This could be string, a metal hook, or an extension of a plastic tab from the ornament, among other mechanisms. Moreover, the ornaments may be supported solely by the string of lights. Other known ways of hanging ornaments from trees and other objects may be used.

Generally, the present invention can employ an infinite number of decorative shapes and sizes, including, for example, spheres, candy canes, words, letters, numbers, Santa Clauses, Christmas trees, snowmen, reindeer, and angels, among others. Additionally, well known commercially-recognizable shapes, such as Mickey Mouse™, a Coca Cola™ bottle profile or other commercially recognized shapes, may be used with the permission of the owners of such commercially recognized shapes and trademarks. Additionally, other holidays might employ lighted ornaments, such as Thanksgiving, Halloween or Easter wherein shapes such as turkeys, pumpkins, witches, ghosts, or Easter bunnies may be used. The list is essentially endless as to the different types of shapes and figures useful for the present invention.

Figure 5:
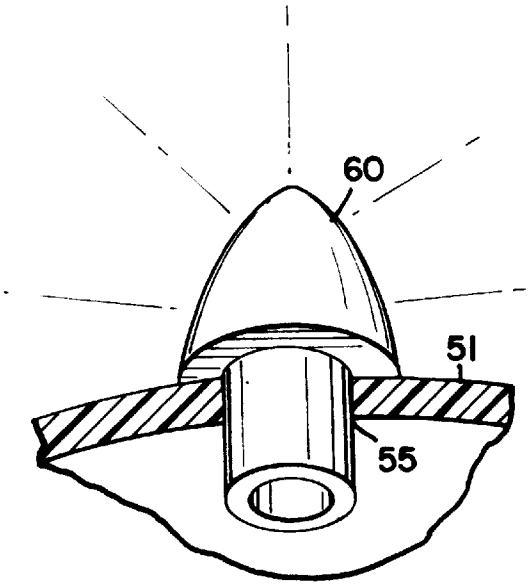
FIG. 5 is a partial enlarged cross-sectional view of a translucent member on the ornament of FIG. 4.
Figure 4:
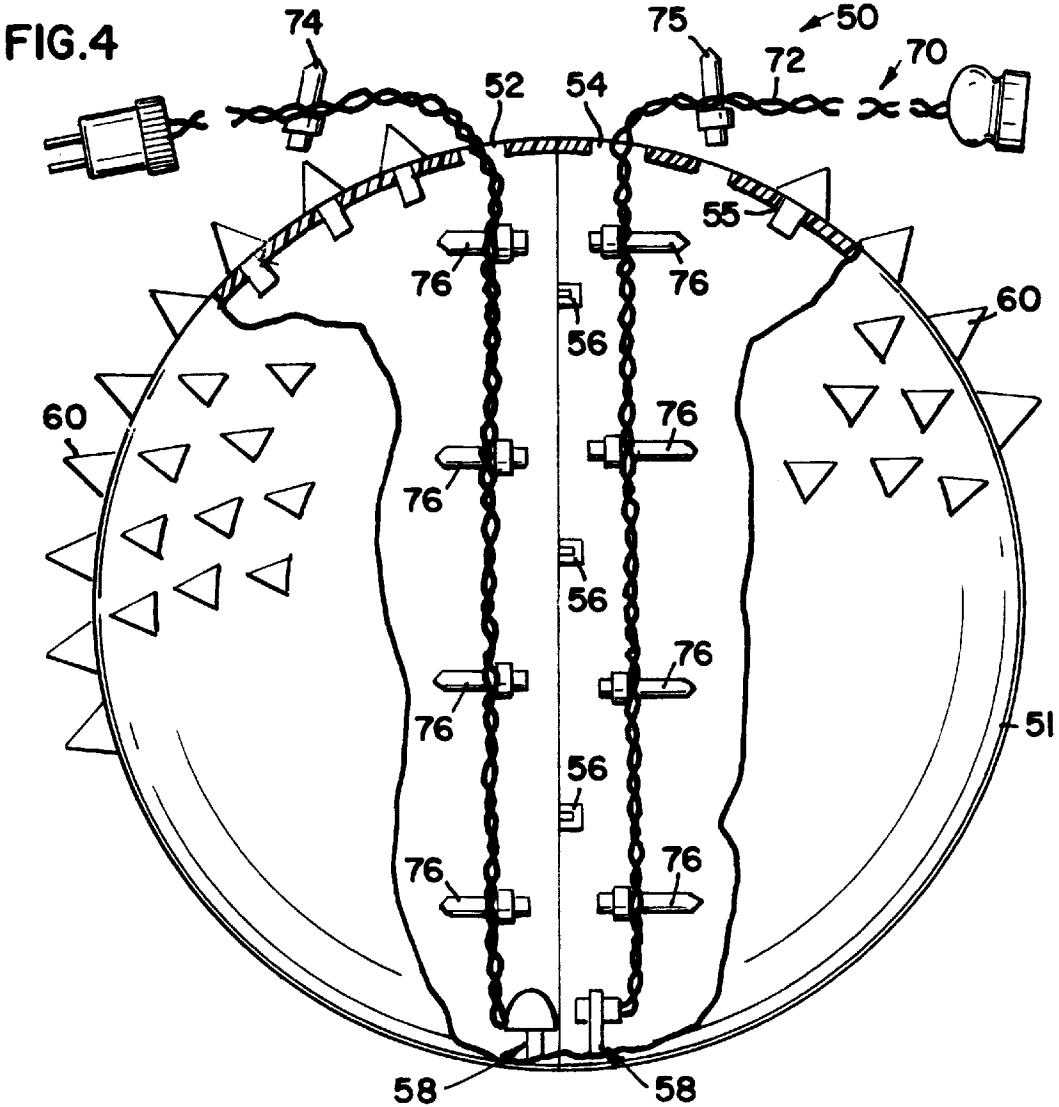
FIG. 4 is a schematic breakaway of another preferred ornament consistent with the invention, with only a portion of the translucent members shown.

An alternate ornament 50 is shown in FIGS. 4 and 5. In this alternative embodiment, a portion of a string of lights 70 (including light bulbs 76) is housed within a shell 51 including clasps 56. Opposing ends of the string of lights (e.g., the ends including light bulbs 74 and 75) exit the shell through cord apertures 52, 54. Light bulbs 76 in this embodiment are disposed within an interior area of the shell by virtue of a hook mechanism 58 which engages cord 72 of string of lights 70 opposite from cord apertures 52, 54 such that the string of lights extends across the interior area of the shell. The light generated by these light bulbs is communicated out of the ornament by a plurality of translucent elements 60 secured to the exterior surface of the shell.

Translucent elements 60 preferably extend through the surface of the shell, e.g., through apertures 55 as shown in FIG. 3. The translucent elements may be hollow plugs or jewels, and may be clear or colored to provide different decorative affects. The translucent elements may be removably or permanently affixed to the shell in any number of manners, e.g., snap-fit or with adhesive. Also, the elements may project from the exterior surface, or may be flush therewith or even recessed relative thereto.

An advantage of ornament 50 is that a fewer number of light bulbs are required in each ornament, which may enable more ornaments to be used with a given string of lights. Any of the above variations disclosed with respect to ornament 10 may also be used in connection with ornament 50. Moreover, it is possible to utilize a combination of translucent members and light bulb apertures in an ornament to provide a combined effect.

The above specification, examples and data provide a complete description of the manufacture and use of the invention. Since many embodiments of the invention can be made without departing from the spirit and scope of the invention, the invention resides in the claims hereinafter appended.

We claim:

1. An ornament for use with a string of lights of the type including a plurality of light bulbs disposed on a common cord, the ornament comprising:

(a) a hollow shell configured to house a portion of the string of lights with multiple light bulbs disposed within the shell such that the light bulbs housed within the hollow shell illuminate the ornament; and (b) at least one cord aperture defined in an exterior surface of the shell and configured to receive opposing ends of the portion of the string of lights housed within the shell.

2. The ornament of claim 1 further comprising at least one light bulb aperture defined in the exterior surface of the shell and configured to receive a light bulb from the portion of the string of lights housed within the shell such that the light bulb projects out of the hollow shell.

3. The ornament of claim 2 wherein the hollow shell includes a plurality of light bulb apertures for receiving a plurality of light bulbs.

4. The ornament of claim 3 wherein the plurality of light bulb apertures substantially cover the exterior surface of the hollow shell such that the ornament is illuminated from substantially all sides.

5. The ornament of claim 2 wherein the hollow shell comprises a plurality of flexible fins extending into the light bulb aperture and configured to secure a light bulb within the light bulb aperture.

6. The ornament of claim 1 further comprising a plurality of translucent members secured to and extending out of the exterior surface of the hollow shell; whereby illumination from the light bulbs housed within the hollow shell is communicated through the plurality of translucent members.

7. The ornament of claim 6 wherein the plurality of translucent members substantially cover the exterior surface of the hollow shell such that the ornament is illuminated from substantially all sides.

8. The ornament of claim 1 wherein the at least one cord aperture includes adjacent cord entrance and cord exit apertures.

9. The ornament of claim 1 wherein the hollow shell further comprises a hook mechanism disposed opposite the cord aperture for engaging the portion of the string of lights housed within the hollow shell such that the string of lights extends across an interior area of the ornament between the cord aperture and the hook mechanism.

10. The ornament of claim 1 wherein the hollow shell is spherical.

11. The ornament of claim 1 wherein the hollow shell comprises a pair of shell halves.

12. The ornament of claim 11 wherein the shell halves are joined along a living hinge.

13. The ornament of claim 11, wherein the hollow shell comprises a plurality of hook and lock clasps which secure the shell halves together.

14. The ornament of claim 1 wherein the shell is made of plastic material.

15. An apparatus, comprising:

(a) a string of lights including a plurality of light bulbs disposed on a common cord; and (b) an ornament, coupled to the string of lights, the ornament including:

(1) a hollow shell housing a portion of the string of lights with multiple light bulbs disposed within the shell;

(2) at least one cord aperture defined in an exterior surface of the shell with opposing ends of the portion of the string of lights housed within the shell projecting through the cord aperture; and (3) a plurality of light bulb apertures defined in the exterior surface of the shell, each receiving a light bulb from the portion of the string of lights housed within the shell such that the light bulb projects out of the hollow shell.

16. The apparatus of claim 15 further comprising a plurality of ornaments coupled to the string of lights.

17. An apparatus, comprising:

(a) a string of lights including a plurality of light bulbs disposed on a common cord; and (b) an ornament, coupled to the string of lights, the ornament including:

(1) a hollow shell housing a portion of the string of lights with multiple light bulbs disposed within the shell;

(2) at least one cord aperture defined in an exterior surface of the shell with opposing ends of the portion of the string of lights housed within the shell projecting through the cord aperture; and (3) a plurality of translucent members secured to and substantially covering the exterior surface of the hollow shell to communicate light from the light bulbs housed within the hollow shell and thereby illuminate the ornament.

18. The apparatus of claim 17 further comprising a plurality of ornaments coupled to the string of lights.

* * * * *